United States Patent [19]

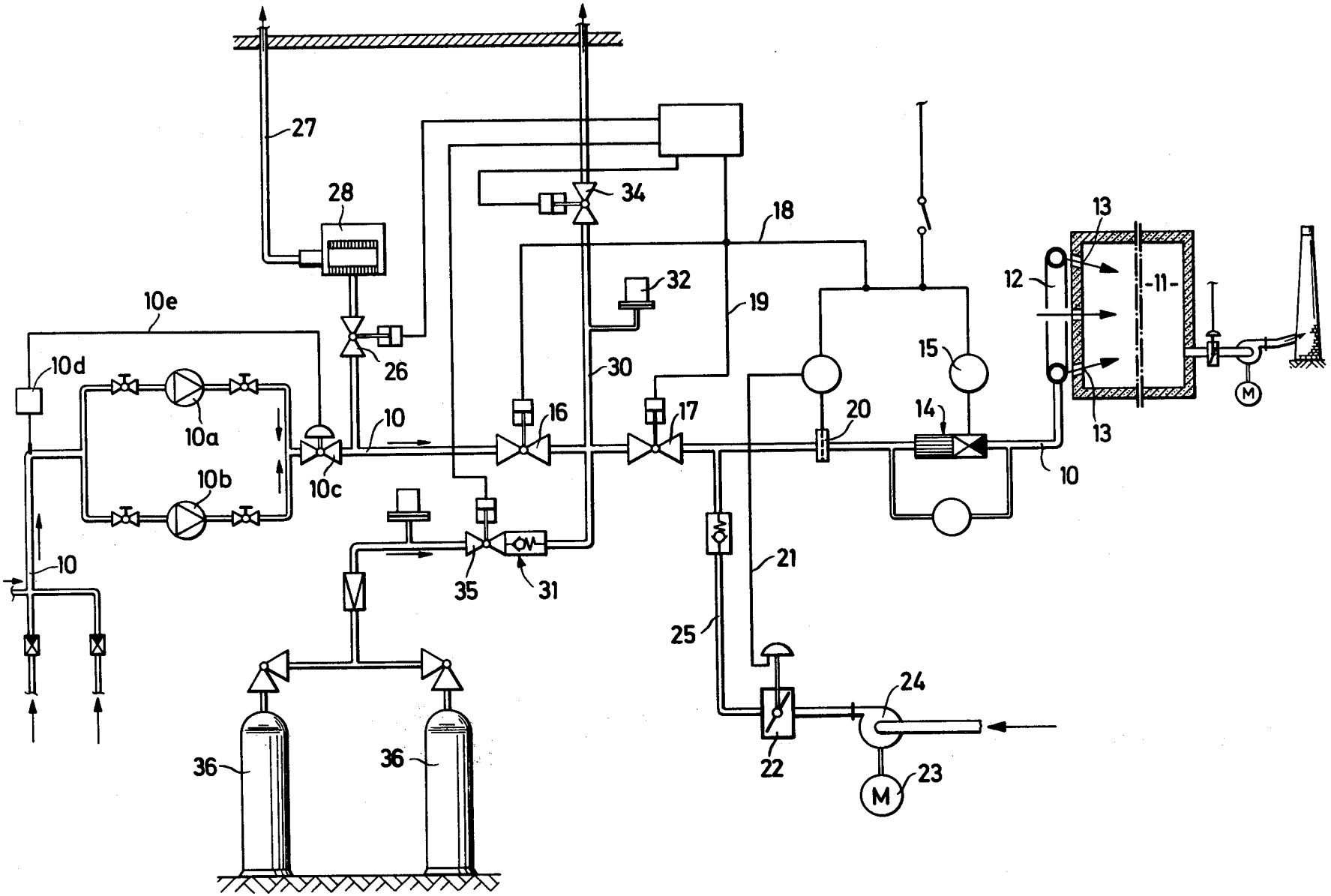
11
12
13
13
10
14
15
20
18
19
21
22
23
24
25
17
32
30
34
16
31
35
26
10
28
27
10c
10a
10b
10e
10d
10
36
36

Hartwig

[11] 4,144,014

[45] Mar. 13, 1979

[54] PROCESS FOR THE THERMAL COMBUSTION OF WASTE GASES AND THERMAL AFTER-BURNING PLANT FOR CARRYING OUT SAID PROCESS

[75] Inventor: Jost W. Hartwig, Frenkendorf, Switzerland

[73] Assignee: Ciba-Geigy Corporation, Ardsley, N.Y.

[21] Appl. No.: 756,657

[22] Filed: Jan. 4, 1977

[51] Int. Cl.[2] ..... F23D 13/20; F23D 11/44

[52] U.S. Cl. ..... 431/5; 431/11; 431/22; 431/89; 110/212

[58] Field of Search ..... 431/5, 202, 22, 16, 431/346, 89, 11; 110/8 A, 344, 345, 212, 237, 210; 23/277 C

[56] References Cited

U.S. PATENT DOCUMENTS

| | | | |
|---|---|---|---|
| 3,876,363 | 4/1975 | La Haye et al. | 431/11 |
| 3,915,620 | 10/1975 | Reed | 431/89 |
| 3,933,444 | 1/1976 | Kilgore | 431/22 |
| 3,999,936 | 12/1976 | Hasselmann | 431/5 |
| 4,013,023 | 3/1977 | Lombana et al. | 110/212 X |
| 4,036,576 | 7/1977 | McCracken | 110/8 A X |

FOREIGN PATENT DOCUMENTS

| | | | |
|---|---|---|---|
| 1581702 | 9/1969 | France | 431/22 |
| 1422977 | 1/1976 | United Kingdom | 431/5 |

*Primary Examiner*—Edward G. Favors

*Assistant Examiner*—Larry Jones

*Attorney, Agent, or Firm*—Harry Falber

[57] ABSTRACT

A process for the thermal after-burning of waste gases containing combustible substances capable of forming an explosive mixture with air in a specific concentration range comprises feeding the waste gas undiluted to a flame with a concentration of combustible substances which varies between the lower and the upper explosion limits, feeding the waste gas to the combustion zone at an entry speed higher than 10 m/sec, and discontinuing the supply of waste gas when a limit temperature of 80° C. is exceeded in the waste gas shortly before its entry into the combustion zone. An after-burning plant for carrying out the aforesaid process comprises a combustion chamber having a burner and a feed pipe for fuel, which latter is preferably gaseous or liquid, a waste gas feed line for introducing waste gas of the above described kind into the combustion chamber, and safety means for preventing the flame penetrating from the combustion chamber into the waste gas feed line, which safety means comprise (a) a dry detonation safety device which is provided in the waste gas feed line upstream of its entry into the combustion chamber, (b) a temperature control device and (c) at least one quick-acting gate valve which is built into the waste gas feed line upstream of the detonation safety device and which can be closed by delayed action by the temperature control device.

7 Claims, 1 Drawing Figure

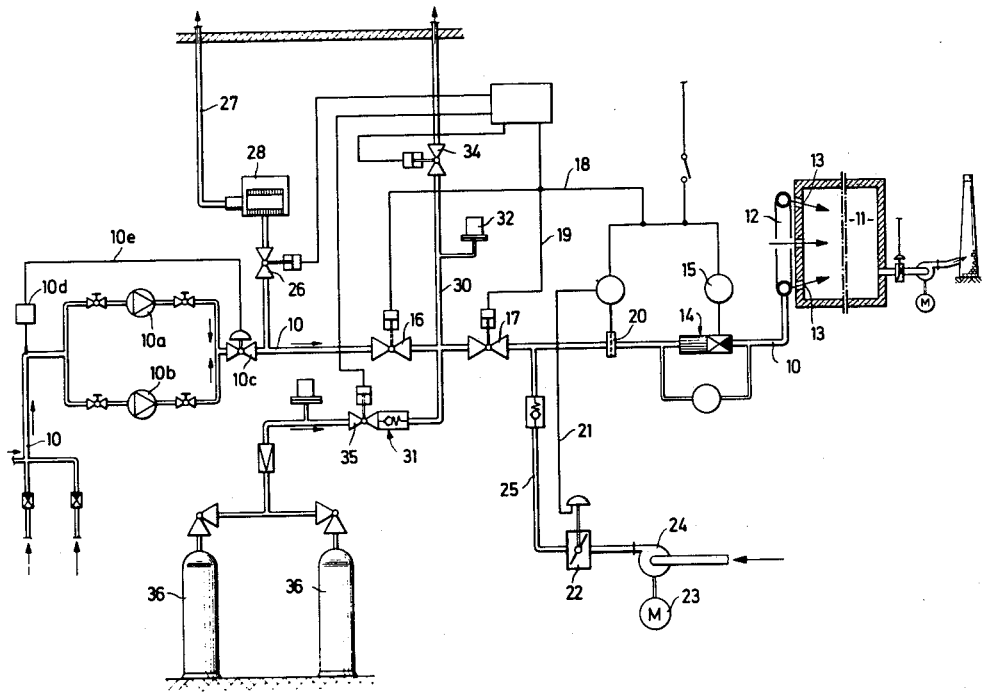

PROCESS FOR THE THERMAL COMBUSTION OF WASTE GASES AND THERMAL AFTER-BURNING PLANT FOR CARRYING OUT SAID PROCESS

The invention relates to a process for the termal combustion of waste gases which contain combustible substances capable of forming an explosive mixture with air in a specific concentration range, which process comprises the feed of waste gas to a combustion-supporting flame and the termal combustion thereof with the aid of this flame in a combustion zone.

In known processes of the above kind (Kirk Othmer, Encyclopedia of Chemical Technology, 2nd edition, vol. 21, pp. 632–633), the waste gases for burning are so heavily diluted before they enter the combustion chamber that their content of combustible organic materials is only in the region of 25% or even less of that concentration which corresponds to the lower explosion limit of the waste gas. However, it is commonly known that the temperature in the combustion chamber must normally be raised to 500°–800° C. or above, and it follows therefrom that the greater the degree of dilution of the waste gases the higher the consumption of fuel for their combustion will be. As a consequence thereof, a large volume of high temperature is generated whose conveyance is expensive and the heat content of which, in manufacturing plants which are equipped with after-burning installations, often cannot be usefully exploited.

It is therefore an object of the present invention to provide a process of the kind initially described wherein, compared with the processes known hitherto, the amounts of gas fed to the combustion, the consumption of energy in the form of heat, and the amount of hot gas generated, are substantially reduced.

This object is attained by a process of the kind initially described, which comprises feeding the waste gas undiluted to the combustion supporting flame with a concentration of combustible substances that changes between the lower and the upper explosion limit, feeding the waste gas to the combustion zone at an entry speed higher than 10 m/sec., and, whenever a limit temperature of 80° C. in the waste gas is exceeded shortly before its entry into the combustion zone, interrupting the supply of waste gas thereto.

During this interruption of the flow of waste gas into the combustion zone, further waste gas which is generated can be discharged above the roof into the surrounding atmosphere.

If the speed at which the gas is fed to the combustion zone falls below 10 m/sec during the operation, then fresh air can be added to the waste gas to increase the rate of flow of the latter.

The waste gases for burning in accordance with the process of the present invention are generated for example in the production of synthetic resins, dispersions and paints. Their content of harmful substances is usually far in excess of the permissible limits laid down in the emission controlling laws of most countries.

Since the concentrations of harmful substances in the waste air generated in the manufacture of such products is frequently within the explosion limits, the process is particularly suitable for the thermal combustion of explosive waste air.

This method of operation has the advantage that the waste air generated can be fed direct into the combustion zone. Dilution to a concentration below the explosion limits is not necessary, so that a better economy in operation is achieved.

The heat generated by the combustion can be recovered for heating proposes in means for utilising a waste heat. The waste gases leaving the combustion zone have concentrations of noxious substances well below the limits permitted by law, so that public interest in environmental protection and safety is taken into account.

It is a further object of the invention to provide a thermal after-burning plant for carrying out the above described process, which plant comprises a combustion chamber having a burner and a feed line for fuel, which is preferably gaseous or liquid, a waste gas feed pipe for conveying the waste gas to the combustion chamber, and safety means for preventing the flame from flashing back from the combustion chamber into the waste gas feed pipe, which safety means comprise a dry detonation safety device located in the waste gas feed line upstream of its opening into the combustion chamber, a temperature control device and at least one quick-acting gate valve which is built into the waste gas feed line upstream from the detonation safety device and which can be closed with delayed action by the temperature control device.

Preferably, a flow meter which controls the admission of fresh air into the waste gas feed line upstream from the detonation safety device is connected to the waste gas feed line between the quick-acting gate valve and the detonation safety device.

The temperature control device is preferably so adjusted that it closes the quick-acting valve when a limit temperature of 80° C. in the detonation safety device is exceeded.

The flow meter is preferably set so as to causes the introduction of fresh air into the waste gas feed line when the rate of flow in the waste gas feed line falls below 10 m/sec.

Vent means for releasing waste gas above the roof, which means open automatically when the quick-acting gate valve closes, can advantageously be provided in the waste gas feed line upstream of the quick-acting gate valve.

The thermal after-burning plant of the present invention comprises preferably a waste heat-exploiting system positioned downstream of the combustion chamber, an exhaust fan and the usual stack.

Whereas, hitherto, flame arresters of relatively simple construction, for example those described in "Chemie-Ingenieur-Technik" 41. Jahrgang, vol. 22, page 1214 (1969), have been used as anti-flashback fitting in the known process for the thermal combustion of waste gases having a content of combustible noxious substances of not more than 25% of the content corresponding to the lower explosion limit, the after-burning plant of the present invention is equipped instead with a dry detonation safety device of the kind described, for instance, in the same publication on page 1218.

In the after-burning plant of the present invention, a flow meter which controls the admission of fresh air into the waste feed line upstream of the detonation safety device can be connected to the waste gas feed line between the quick-acting gate valve and the detonation safety device.

The temperature control device of the detonation safety device is preferably set in such a way that it closes the quick-acting gate valve when a limit temperature of 80° C. is exceeded.

The flow meter referred to above is so set that it releases the flow of fresh air into the system when the rate of flow in the waste gas feed line falls below 10 m/sec.

The combustion chamber is preferably so designed that the sojourn time of the waste gases therein corresponds to at least 0.3 sec at a temperature of over 900° C.

The invention is described in greater detail in connection with the accompanying drawing which shows schematically a preferred embodiment of the after-burning plant of the present invention.

The waste gas originating from one or more waste gas sources (not shown) is initially pumped or forced with pressure into the plant through a waste gas feed pipe 10 by using liquid seal pumps or ventilators 10*a* and 10*b*. The pressure at the flow controller valve 10*c* is preferably about 50 millibars above ambient pressure. The controller valve 10*c* is regulated by the pressure controller 10*d* via the reduced pressure control circuit 10*e*.

While streaming through the waste gas feed pipe 10, the waste gas next passes through a quick-acting twin valve system comprising quick-acting gate valves 16 and 17, a flow rate meter 20 and a detonation safety device 14, and is then, in the course of normal operation, fed into a combustion chamber 11 of known brick construction in which it is thermally oxidized. As already mentioned, the design of the combustion chamber ensures a sojourn time of the waste gases of longer than 0.3 sec. at a temperature of over 900° C. and thus meets the legal requirements of many countries.

The nature of the fuel used in the burner will depend on the local conditions and the burner can be designed for gas or oil. The burner installation consists of the burner 12 with flame controller, ignition burner and burner control device (not shown individually).

The waste gas is blown in substantially parallel to the flame through a number of nozzles 13 spaced over the periphery.

In lieu of the customary flame arresters, the safety means for carrying out the process of the invention with a waste gas whose concentration of combustible substances varies in the range between the lower and the upper explosion limit is a dry detonation safety device 14 of the above mentioned construction, associated with a temperature control device 15 which responds instantaneously when the temperature in the detonation safety device 14 exceeds 80° C. and which, via circuit lines 18 and 19, causes the quick-acting gate valves 16 and 17 to close with a delay of 30 seconds.

If the temperature in the detonation safety device 14 falls again below 80° C. before 30 seconds have elapsed, then the quick-acting gate valves 16 and 17 do not close. A suitable valve of this kind is, for instance, a dual shutoff combination such as described in a prospectus of Albrecht-Automatik-KG, Cologne, Germany.

A flow meter 20 in the form of a conventional diaphragm monitors the rate of flow of the waste gas in the waste gas feed pipe 10 and, when the rate of flow falls below 10m/sec, activates via the circuit 21 a valve 22 through which fresh air ("false" air) is then blown, by means of a fan 24 driven by the motor 23, into the waste gas feed pipe 10 through the feed pipe 25 in order to increase the rate of flow in the former pipe to above 10 m/sec.

If the quick-acting gate valves 16 and 17 are closed, then valve 26 is simultaneously activated and the fresh waste gas which continues to flow into the plant is discharged above the roof through a discharge pipe 27. A flame-preventing device 28 is advantageously built into the discharge pipe 27.

The dual valve system 16 and 17 is provided with intermediate ventilation 30 and density control means 31.

The quick-acting gate valves 16 and 17 are biassed by spring means into the closed position. A tightness control (for freedom from leaks) is carried out before the start of each operation, i.e. during the rinsing procedure and after each shutoff. During this tightness control, the line section between the two quick-acting gate valves 16 and 17 is blown out with nitrogen from a nitrogen source 36 while opening the valve 35 and subsequently a nitrogen pressure which is higher than the waste air pressure is built up. By means of a pressure-controlling device 32 and a time relay, the tightness of the aforesaid line section is tested. If this tightness is found to be present, the information "tightness control positive" is relayed and the plant can be put into operation. Thereafter, the line section is relieved from pressure by means of a vent valve 34. This vent valve 34 is closed before the waste air is admitted into the tested line section.

If the main firing device in the combustion chamber ceases to function, i.e. if a photocell at the burner reports no flame, the quick-acting gate valves 16 and 17 are closed without delay and the discharge outlet 27 above the roof is opened. A combined automatic gas-oil burner (e.g. with a capacity of 6 kcal/h, a range of adjustment of 1:6, a minimum consumption of 60 kg/h of oil and a maximum gas pressure of 2000 mm water column), into which the waste gas is blown parallel to the flame through a number of jets 13 which are distributed in a circle about the flame, is used for the combustion of the waste gas. Furthermore, a flashback is prevented by the detonation safety device, flow meters and temperature control devices.

Good results are achieved with this system in lowering the content of CO and N-oxides in the waste gas.

The control system for the burner installation is so designed that optimum combustion takes place under all working conditions. In this way high temperature peaks in the combustion chamber are avoided and the service life of the brick lining is prolonged. The accumulation of heat is restricted to a minimum in accordance with the amounts of harmful substances to be destroyed — which is of advantage in production plants with a low heat consumption.

The thermal energy contained in the flue gas can be utilized for heating purposes in a waste heat boiler (not shown). If the heat requirement is greater than the supply of heat in the combustion chamber, the balance can be made up by using an additional burner in the waste heat system.

An exhaust fan is installed behind the waste heat boiler, so that the entire plant is operated at slightly reduced pressure (see GAKOMAT burner, type LO-NE 600-P 120, light oil/earth gas, manufactured by Babcock).

As pressure regulators there are used for example, those having an adjusting scale, which are marketed by Messrs. Karl Dunges, Steuer- und Regeltechnik, 706 Schorndorf, Germany (DV GW-A, No. G 1626–1630).

I claim:

1. A process for the thermal after-burning of waste gases which contain combustible substances capable of forming an explosive mixture with air in a specific concentration range, which process comprises feeding the waste gas undiluted to a flame with a concentration of combustible substances which varies between the lower and the upper explosion limits, feeding the waste gas to the combustion zone at an entry speed higher than 10 m/sec, and discontinuing the supply of waste gas when a limit temperature of 80° C. is exceeded in the waste gas shortly before its entry into the combustion zone.

2. A process according to claim 1, wherein fresh air is fed to the waste gas when the speed at which the waste gas is conveyed to the combustion zone falls below 10 m/sec in order to increase the rate of flow again to at least 10 m/sec.

3. A process according to claim 1, wherein at the start of the operation fresh air is introduced into the waste gas being fed to the combustion zone and thereafter waste gas is admitted to the fresh air flow.

4. An after-burning plant for the thermal after-burning of waste gases which contain combustible substances capable of forming an explosive mixture with air in a specific concentration range, which comprises a combustion chamber having a burner and a feed pipe for fuel, which latter is preferably gaseous or liquid, a waste gas feed line for introducing waste gas of the above described kind into the combustion chamber, safety means for preventing the flame penetrating from the combustion chamber into the waste gas feed line, said safety means comprising (a) a dry detonation safety device which is provided in the waste gas feed line upstream of its entry into the combustion chamber, (b) a temperature control device associated with said dry detonation safety device to control the temperature in said device and (c) at least one quick-acting gate valve which is built into the waste gas feed line upstream of the detonation safety device and which can be closed by delayed action by the temperature control device, and a flow rate meter connected to the waste gas feed line between the at least one quick-acting gate valve and the detonation safety device for controlling the supply of fresh air into the waste gas feed line upstream of the detonation safety device.

5. An after-burning plant according to claim 4, wherein the temperature control device closes the quick-acting gate valve when a limit temperature of 80° C. is exceeded.

6. An after-burning plant according to claim 4, wherein the flow rate meter admits a stream of fresh air into the waste gas feed line when the rate of flow in the said line falls below 10 m/sec.

7. An after-burning plant according to claim 4, wherein said safety means contains two quick-acting gate valves and, in addition, (d) a source of nitrogen and (e) pressure-controlling means, both said source of nitrogen and said pressure-controlling means being connected to said feed line in a section thereof between said two gate valves.

* * * * *